United States Patent [19]

Morley

[11] Patent Number: 4,605,052

[45] Date of Patent: Aug. 12, 1986

[54] CURING BINDERS FOR FOUNDRY MOULDS AND CORES

[75] Inventor: John G. Morley, Alcester, England

[73] Assignee: BCIRA, Birmingham, England

[21] Appl. No.: 765,101

[22] Filed: Aug. 13, 1985

[30] Foreign Application Priority Data

Aug. 16, 1984 [GB] United Kingdom ..... 8420877

[51] Int. Cl.[4] ..... B22C 9/12

[52] U.S. Cl. ..... 164/16; 164/527; 164/528; 523/139

[58] Field of Search ..... 523/139; 164/16, 527, 164/528; 106/38.2

[56] References Cited

U.S. PATENT DOCUMENTS

| | | | |
|---|---|---|---|
| 3,645,937 | 2/1972 | Lang et al. | 523/139 |
| 4,269,256 | 5/1981 | Nakazawa et al. | 523/139 |
| 4,495,980 | 1/1985 | Morley | 164/16 |
| 4,526,219 | 7/1985 | Dunnavant et al. | 523/139 |

*Primary Examiner*—Lewis T. Jacobs

*Attorney, Agent, or Firm*—Scrivener Clarke Scrivener and Johnson

[57] ABSTRACT

A foundry binder of the water-soluble alkali metal polyacrylate type having additives that include lime is cured by the use of the vapour of a low-boiling point organic ester having not more than three carbon atoms, primarily methyl formate, entrained in a carrier gas, e.g. carbon dioxide or nitrogen.

8 Claims, No Drawings

CURING BINDERS FOR FOUNDRY MOULDS AND CORES

This invention relates to a method of, and means for, curing the binders that are used to harden foundry moulds and cores of refractory material such as sand.

In my U.S. Pat. No. 4,495,980 I have described a new organic binder system for foundry moulds and cores in which a mixture based upon an organic material with certain additives and having a carefully controlled pH (hydrogen ion concentration) is hardened by passing carbon dioxide gas through it. In the specification of my U.S. patent application Ser. No. 717,682 (not yet published) we have described an improvement which can be obtained in the binder by the addition of certain substances such as zinc oxide and calcium citrate.

In both those earlier disclosures the organic binder to which the inventions are applied is a sodium polyacrylate water-soluble resin and the additives are inorganic materials consisting either of lime or, preferably, a mixture of lime (calcium hydroxide), magnesium oxide and calcium citrate.

Moulds and cores made according to the above inventions have satisfactory hardness and strength in the 'as-gassed' condition, i.e. immediately after the gas has been passed through, but if the core or mould is left standing for a period of time this is considerably improved and the strength reaches a high value after about 24 hours.

The aim of the invention is to provide a still further improvement in the strength of foundry moulds and cores using the kinds of binders mentioned above, in particular to obtain a high initial strength that allows the mould or core to be handled or transported immediately without fear of damage.

We have now discovered that by incorporating the vapour of a low-alkyl ester of a low-carbon aliphatic acid into the carbon dioxide gas used for curing the moulds a considerable improvement in the immediate ('as-gassed') strength and hardness is achieved. A similar result can be obtained by using such a vapour entrained in an inert gas such as nitrogen, or even air. For reasons of safety, the use of carbon dioxide or nitrogen (i.e. an oxygen-free gas) as the carrier gas is preferred, but air is substantially equally effective.

The alkyl ester must be that of a low alkyl group and of relatively low molecular weight, simply in order to ensure that it is sufficiently volatile to be entrained in the gas. In practice the preferred material is the lowest of all, methyl formate, although ethyl formate shows some results and even methyl acetate is a possibility, although higher groupings are not satisfactory.

It is true that methyl formate has previously been proposed, entrained in nitrogen, as the sole curing agent for a quite different type of resin, notably potassium alkali phenol formaldehyde resin as described in the published European Patent Application No. 0086615, in which it is made clear that the composition of the resin is very critical to successful hardening by this means. The resin to which the present invention is applied is of a completely different type, and for the hardening to occur when gassing with the methyl formate or similar low-boiling-point esters proposed in the present Patent Application it is essential that the inorganic additives mentioned in our earlier applications, referred to above, are present in the sand mixture. No strength is developed in moulds or cores which are gassed with gas containing methyl formate vapour but which are bonded only with sodium polyacrylate resin prepared as described in the earlier applications but without the additives.

Methyl formate is the preferred ester, as it has the lowest boiling point of the series and therefore produces a vapour most readily by bubbling the carrier gas through the liquid ester at room temperature.

The invention will now be further described with reference to certain examples.

The following Table 1 shows the results obtained when test cores in the form of standard 'two-inch' (5cm×5cm) AFS (American Foundry Society) compression test specimens, bonded with the sodium polyacrylate-based binder, were hardened, first by carbon dioxide alone, second by methyl formate, carbon dioxide introduced by bubbling carbon dioxide through liquid methyl formate at room temperature and, third, by methyl formate introduced by bubbling nitrogen gas through methyl formate at room temperature. The rate of flow of the gas in each case was 2.5 liters per minute, whether bubbled through methyl formate or not.

The sand mixtures used were as follows:

A: Chelford 60 sand with a binder comprising 3.6% of sodium polyacrylate and 1.4% of additives comprising 1% lime, 0.3% magnesium oxide and 0.1% calcium citrate.

B: Bathgate sand with the same binder and additives as mixture A.

C: Redhill 60 sand with the same binder and additives as mixture A.

D: Chelford 60 sand (the same as in mixture A) with 3.6% sodium polyacrylate and 1.3% of lime as the sole additive.

TABLE 1

| | | | Results Compression Strength (N/sq. cm) | | | |
|---|---|---|---|---|---|---|
| | | | Stored at 30% relative humidity | | | Nitrogen + |
| Sand Mixture | Time (hours) | Gassing (Seconds) | $CO_2$ alone | $CO_2$ methyl formate | Nitrogen + methyl formate | methyl formate stored at 90% relative humidity |
| A | 0 | 20 | 86 | 163 | 200 | 200 |
| | | 60 | 90 | 163 | 188 | 188 |
| | 4 | 20 | 192 | 183 | — | — |
| | 24 | 20 | 441 | 208 | 459 | 188 |
| | | 60 | 296 | 256 | 454 | 178 |
| B | 0 | 20 | 83 | 181 | — | — |
| | | 60 | 80 | 166 | — | — |
| | 4 | 20 | 210 | 195 | — | — |
| | 24 | 20 | 360 | 224 | — | — |
| | | 60 | 263 | 256 | — | — |
| C | 0 | 20 | 79 | 190 | — | — |
| | | 60 | 76 | 180 | — | — |
| | 4 | 20 | 228 | 238 | — | — |
| | 24 | 20 | 449 | 380 | — | — |
| | | 60 | 464 | 419 | — | — |
| D | 0 | 20 | 56 | — | 217 | 217 |
| | | 60 | 49 | — | 172 | 172 |
| | 4 | 20 | — | — | — | — |
| | 24 | 20 | — | — | — | 208 |
| | | 60 | — | — | — | 183 |

As will be seen the cores were in some cases gassed for twenty seconds and in others for sixty seconds. Their strengths were measured immediately after gassing ('as gassed'), and after standing for four hours, and after standing for twenty four hours. The sand/binder mixtures were those described in the specification of the above-mentioned unpublished application No. 717,682.

It will be seen that, after the cores had been gassed with carbon dioxide alone, a strength of around 80 Newtons/sq.cm was achieved, but that after the core had stood for twenty four hours the strength has increased to 300 Newtons/sq.cm. or more.

With each of the three kinds of gassing the specimen was left, after gassing in a warm room at a temperature of 28° C. and about 30% relative humidity.

Table 1 shows that when each of the same mixtures A, B and C was gassed with carbon dioxide that had been bubbled through methyl formate the immediate strengths were approximately double those achieved with carbon dioxide alone, but after standing for twenty four hours they had strengths slightly lower than those gassed with pure carbon dioxide.

When the cores were gassed with carbon dioxide containing methyl formate at a temperature of 20° C. it was found that the consumption of methyl formate was 8.2% of the weight of polyacrylate resin present; this increased to 32.7% of the weight of resin when the temperature of the methyl formate was raised above its boiling point (which is 31.8° C.) to 50° C.

As Table 1 shows, when the mixture A was gassed with methyl formate entrained in nitrogen, not carbon dioxide, the initial as-gassed strengths were even higher, being in the range 188 to 200 N/sq.cm. These samples became very strong, at around 450 N/sq.cm, after standing for twenty-four hours at a temperature of 28° C. and 30% relative humidity.

The mixture D was made in accordance with the earlier U.S. Pat. No. 4,495,980 in which the additive comprised 1.3% of lime, but no magnesium oxide or calcium citrate. It will be seen that the immediate strength was around 50 N/sq.cm when gassed with carbon dioxide alone. When the specimen was gassed with methyl formate in nitrogen immediate strengths of 172 to 217 N/sq.cm were achieved.

The right-hand column in Table 1 shows the result of additional tests carried out, again using nitrogen bubbled through methyl formate, in which, after gassing, the test samples were held for twenty-four hours under adverse conditions, represented by a temperature of 20° C. and 90% relative humidity. These conditions produced a slight fall in strength, but even so they remained hard and were insoluble in water after standing, illustrating the fact that methyl formate is a very satisfactory material for gassing this kind of binder, even under adverse storage conditions. Furthermore, use of the invention produces cores and moulds which in use in the foundry, have similar characteristics to those gassed with carbon dioxide alone.

In addition to the foundry-grade silica sands used in the examples A to D, the sodium polyacrylate binder is capable of use with beach sands and dune sands which, because of the presence of alkaline impurities, are not suitable for use with most foundry resin binders.

Although, as explained earlier, methyl formate, which has a boiling point of 31.8° C., is the best material for use with the present invention, other esters are possible. In particular ethyl formate (boiling point 54.2° C.) can be used, either at room temperature, as was the methyl formate in the examples above, or at an elevated temperature, again using a flow rate for the carbon dioxide or the nitrogen of 2.5 liters per minute. The results of an experiment using the sand mixture A are shown in Table 2 below.

TABLE 2

| Mixture | Time (hours) | Gassing Time (Seconds) | Compression Strengths (N/sq. cm) Carbon dioxide and ethyl formate | Nitrogen and ethyl formate |
|---|---|---|---|---|
| A | 0 | 20 | 108 | 119 |
| gassed | | 60 | 135 | 224 |
| at 20° C. | 24 | 20 | 341 | 247 |
| | | 60 | 291 | 370 |
| A | 0 | 20 | 199 | 193 |
| gassed | | 60 | 202 | 195 |
| at 50° C. | 24 | 20 | 321 | 326 |
| | | 60 | 217 | 321 |

The specimens were standard cylindrical AFS specimens as in the experiments with the methyl formate. They were stored, after gassing, at 20° C. in 60% relative humidity. The results listed in Table 2 show that ethyl formate is an effective curing agent for the polyacrylate-plus-additive binder used in sand mixture A, and that by raising the temperature one can obtain a substantial improvement (almost double) in the immediate as-gassed strength.

Finally, experiments were conducted to ascertain the effectiveness of esters of acids of higher carbon content than formic acid. In particular, tests were carried out to gas specimens of the same sand mixture as before and using carbon dioxide and nitrogen which had been bubbled through methyl acetate and ethyl acetate. These materials were both found to be ineffective when vapourised in nitrogen at either 20° C. or 50° C.

When methyl acetate and ethyl acetate vapourised in carbon dioxide were used, the binder was hardened by the carbon dioxide in the usual way and the presence of the acetate, either at 20° C. or 50° C. gave no improvement in the immediate as-gassed strength. However, in the case of methyl acetate, particularly high strengths were developed after the specimens had been stored for twenty-four hours.

Experiments were also conducted to compare the effectiveness of methyl acetate with that of methyl formate. The results of these are shown in Table 3, in which again the sand-binder mixture A was gassed, first with carbon dioxide bubbled through methyl acetate (for twenty seconds and for sixty seconds), then with carbon dioxide bubbled through a mixture of three parts by volume of methyl acetate with one of methyl formate, next with equal parts of the acetate and formate, then one part of acetate with three parts of formate and finally with carbon dioxide bubbled through pure methyl formate. The strength was measured as-gassed, after one hour, after four hours and after twenty-four hours.

TABLE 3

| Carbon Dioxide with Ester | Gassing Time (Seconds) | Compressions Strength (N/sq. cm) after: 0 | 1 hour | 4 hours | 24 hours |
|---|---|---|---|---|---|
| 100% methyl | 20 | 80 | — | — | 414 |
| acetate | 60 | 91 | — | — | 430 |
| 75% methyl | 20 | 136 | — | — | — |
| acetate | 25 | 206 | 218 | 241 | 365 |
| 50/50 formate/ | 20 | 194 | 219 | 229 | 400 |
| acetate | | | | | |
| 75% formate | 20 | 206 | 212 | 202 | 365 |
| 100% methyl | 20 | 189 | 183 | 206 | 272 |
| formate | | | | | |

The above results show that use of a fifty, fifty acetate/formate mixture does produce a significantly higher strength after the specimen has stood for twenty four hours than the methyl formate alone, and has a similar immediate ('as-gassed') strength, whereas 100% methyl acetate results in a poor immediate strength.

It will be understood that all three of the esters mentioned may be used in a combination of any two, or all three in varying proportions according to need.

I claim:

1. A method of curing the binder in a foundry mould or core made of a granular refractory material together with a water-soluble alkali metal polyacrylate binder including an additive which at least partially comprises lime, said method comprising passing through said mould or core a carrier gas containing a significant proportion of the vapour of an alkyl ester containing not more than three carbon atoms.

2. The method of claim 1, wherein said alkyl ester is methyl formate.

3. The method of claim 1 wherein said alkyl ester is ethyl formate.

4. The method of claim 1 wherein said ester includes methyl acetate.

5. The method of claim 1 wherein said ester is a mixture of at least two of methyl formate, methyl acetate and ethyl formate.

6. The method of claim 1 wherein said carrier gas is carbon dioxide.

7. The method of claim 1 wherein said carrier gas is nitrogen.

8. The method of claim 1 wherein said additive to the binder includes a metal oxide and calcium citrate.

* * * * *